US006057868A

United States Patent [19]

Kagayama et al.

[11] Patent Number: 6,057,868

[45] Date of Patent: May 2, 2000

[54] IMAGE FORMING APPARATUS

[75] Inventors: Shigeru Kagayama, Owariasahi; Osamu Nagata, Nishikamo-gun, both of Japan

[73] Assignee: Brother Kogyo Kabushiki Kaisha, Nagoya, Japan

[21] Appl. No.: 09/000,931

[22] Filed: Dec. 30, 1997

[30] Foreign Application Priority Data

Jan. 8, 1997 [JP] Japan ..... 9-001403

[51] Int. Cl.[7] ..... B41J 2/41; B41J 2/06; B41J 2/385

[52] U.S. Cl. ..... 347/151; 347/55; 347/115

[58] Field of Search ..... 347/43, 115, 151, 347/158, 55; 399/302, 226, 227, 297, 298, 223

[56] References Cited

U.S. PATENT DOCUMENTS 5,353,050 10/1994 Kagayama ..... 347/55
5,552,814 9/1996 Maeda et al. ..... 347/55
5,815,775 9/1998 Miyasaka et al. ..... 399/162

FOREIGN PATENT DOCUMENTS 2-297570 12/1990 Japan .

*Primary Examiner*—N. Le
*Assistant Examiner*—Thinh Nguyen
*Attorney, Agent, or Firm*—Oliff & Berridge, PLC

[57] ABSTRACT

A motor drives four final gears provided to four image recording units via a driving belt. Each of the image recording units corresponds to one of yellow, magenta, cyan and black. Each final gear is connected to a rotation axis of a toner feed roller via an electromagnetic clutch. If a black-and-white image is to be formed, only the electromagnetic clutch associated with the black image recording unit is connected, while the rest of the electromagnetic clutches are kept disconnected so that unnecessary image recording units are not driven. This arrangement improves the image quality and durability of the apparatus, and achieves a reliable color printing operation.

21 Claims, 8 Drawing Sheets

IMAGE FORMING APPARATUS

BACKGROUND OF THE INVENTION

1. Field of the Invention

This invention relates to an image forming apparatus used in copying machines, facsimile machines, printers and similar devices, and more particularly to an image recording apparatus which is capable of recording multicolor images.

2. Description of Related Art

Many types of image forming apparatuses having image recording units in them are conventionally known. In these image recording units, electrode arrays called aperture electrodes are generally used.

An aperture electrode is made of a flexible insulated sheet. A plurality of minute apertures, which serve as charge passages, are formed in the flexible insulated sheet. A control electrode made of copper leaf is provided at each of the apertures.

Japanese Laid-open Patent Publication No. 2-297570 discloses an image forming apparatus which feeds a recording medium (e.g., recording paper) so that a front surface of the recording paper faces the aperture electrode, which is made of a flexible insulated sheet. A toner supply mechanism is positioned on the side of the aperture electrode opposite the recording paper. The toner supply mechanism supplies frictionally charged toner particles to the aperture electrode. A voltage applied to each of a plurality of control electrodes on the aperture electrode is individually controlled by an electrode driving circuit, based on image signals, so as to control the flow of charged toner particles through corresponding apertures. The toner particles which have passed through the apertures are attracted by an electric field produced by a back electrode which is positioned at a back surface of the recording paper. A high voltage is applied to the back electrode so that the back electrode attracts the charged toner particles. The toner particles which are attracted to the back electrode adhere onto an image forming surface, i.e., the front surface, of the recording paper and form a toner image on the recording medium.

Meanwhile, U.S. Pat. No. 5,353,050 discloses an image recording apparatus that includes three stages of image recording units, each of which corresponds to one of yellow, magenta and cyan. The three stages of image recording units are positioned along a paper-feed direction at predetermined intervals in order to form a color image. Four stages of image recording units corresponding to yellow, magenta, cyan and black may also be used. The four stages of image recording units are also arranged along the paper-feed direction at predetermined intervals.

In the conventional image forming apparatuses, the toner supply mechanisms for the three (or four) image recording units are typically driven by a single driving source, such as a motor. However, the conventional image forming apparatuses are subject to several problems.

One problem is that, in actual office environments, even if a full-color printer is installed, only one or two specific colors are predominantly used to print or record images. Because a single motor is commonly used to drive the multiple toner supply mechanisms, the toner supply mechanisms for image recording units that are not needed for a printing job are activated along with the image recording units that are actually needed for the printing job. This may cause the colors which are not required for the printing job to scatter or adhere onto the recording medium, thereby producing a stain on the output image.

Moreover, because the recording units that do not contribute to the printing operation are always driven, the durability of the recording units and the apparatus itself is deteriorated.

SUMMARY OF THE INVENTION

It is therefore an object of the invention to overcome the problems of the conventional art and provide a color image forming apparatus which can print reliably with an improved image quality, and which has a high durability.

In order to achieve this object, the image forming apparatus in accordance with the invention comprises a plurality of image recording units, each having a built-in toner supply mechanism for forming images, a driving system for driving the plurality of image recording units, and a driving separation mechanism for separating the driving of one or more image recording units from the plurality of image recording units. The image recording units that correspond to colors that are actually used are selectively driven, while the remaining recording units which are not used for that printing operation are kept at rest. This structure prevents toner of unnecessary colors from adhering onto the recording medium, and the life of the apparatus from being wasted due to the unnecessary driving of non-used recording units. Consequently, the image quality and the durability of the apparatus are improved, while reliable printing is ensured.

The image forming apparatus may further comprises a control unit for controlling the driving separation mechanism so that only the image recording units of necessary colors are driven.

The driving separation mechanism which is controlled by the control unit has electromagnetic clutches. The electromagnetic clutches separate one or more image recording units from the plurality of image recording units. The driving separation mechanism drives only the selected and separated image recording units. In other words, only those electromagnetic clutches for actually used image recording units are connected, while the electromagnetic clutches for non-used image recording units are kept disconnected.

The driving separation mechanism has a motor for driving the multiple image recording units. Each of the image recording units has an electromagnetic clutch. Although, the motor can drive all of the image recording units at one time, only those image recording units whose electromagnetic clutches are connected are actually driven.

Each of the image recording units comprise an electrode array made of a flexible insulated sheet. A row of multiple toner passages are formed in the flexible insulated sheet in a direction perpendicular to the feeding direction of a recording medium. An electrode is provided at each toner passage.

The image forming apparatus also comprises a toner supply mechanism for supplying charged toner particles to the toner passages, and an electrode driving circuit that individually controls a voltage applied to each of the electrodes of the electrode array. The toner supply mechanism supplies the toner particles to the toner passages of the electrode array, and the toner particles are only ejected from toner passages to which toner ejection voltages are applied by the electrode driving circuit.

The toner supply mechanism comprises a toner container for containing toner particles, a toner feed roller for feeding the toner particles to the toner passages, toner stirring blades for stirring the toner particles disposed in the toner container, and a toner supply roller for supplying the stirred toner particles to the toner feed roller.

The image forming apparatus may further comprise a driving pulley fixed to the rotation shaft of the motor, an input pulley to which the rotation of the driving pulley is transmitted through a driving belt, an input shaft driving gear fixed to the input pulley, an intermediate gear engaged with the input shaft driving gear, and a final gear engaged with the intermediate gear. The final gear is connected to the axis of the toner feed roller via the electromagnetic clutch. This structure allows the electromagnetic clutches to control the transmission of the driving force from the rotation shaft of the motor to the toner feed roller.

The image forming apparatus may further comprise an intermediate transfer medium for receiving a toner image at one surface and transferring the toner image onto the recording medium, and a back electrode disposed at the other surface of the intermediate transfer medium. Thus, the intermediate transfer medium is positioned between the back electrode and the toner passages of the respective image recording units. The toner particles ejected from the toner passages are attracted toward the back electrode, and adhere to the top surface of the intermediate transfer medium, from which the toner image is transferred onto the image recording medium.

Four image recording units which correspond to yellow, magenta, cyan and black, respectively, are provided in the image forming apparatus. When a black-and-white image, such as text, is to be formed, the driving separation mechanism drives the black image recording unit separately from the other image recording units. On the other hand, when a full-color image is to be formed, the driving separation mechanism drives all of the image recording units at one time.

The driving system has a plurality of motors for driving the multiple image recording units. When a single-color image is formed, the control unit controls the motors so that only one of the motors is driven. This structure does not require the use of electromagnetic clutches, and directly drives the image recording unit which is used in image formation.

In a situation where four image recording units are provided, each corresponding to yellow, magenta, cyan and black, respectively, and a black-and-white image is to be formed, then the control unit drives only the black image recording unit. When a full-color image is to be formed, all of the motors for driving the four image recording units are driven at a time.

BRIEF DESCRIPTION OF THE DRAWINGS

The above and other objects, features, and advantages of the invention will be apparent from the detailed description which follows with reference to the attached drawings wherein.

DETAILED DESCRIPTION OF THE PREFERRED EMBODIMENT

The preferred embodiment of the invention will now be described with reference to the attached drawings.

Figure 1:
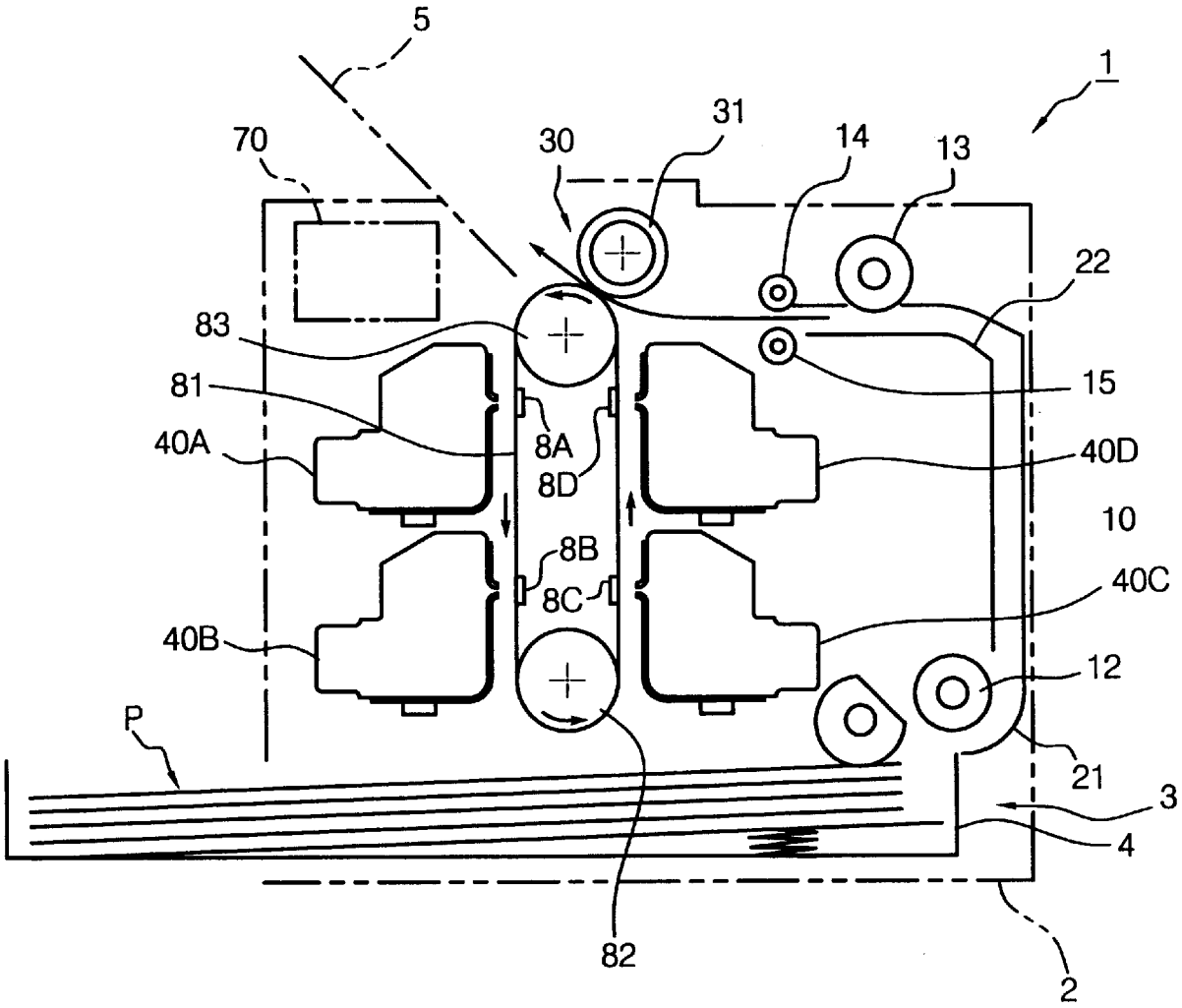
FIG. 1 schematically illustrates the structure of an image forming apparatus according to an embodiment of the invention.

FIG. 1 schematically shows the structure of a color image forming apparatus 1. A paper cassette holder 3, a paper transporting mechanism 10, a fixing mechanism 30, four image recording units 40A through 40D, four back electrodes 8A through 8D, a transfer unit 80, and a control unit 70 are all disposed within a main frame 2. A color image is formed on paper P which serves as an image recording medium.

The paper cassette holder 3 is positioned on the bottom of the main frame 2, and holds several cassettes 4, each of which contains a different type of paper P. A receiving tray 5 is provided on the top of the main frame 2 so as to receive paper P which is output from the paper transporting mechanism 10. The output paper P has an image printed on it.

The paper transporting mechanism 10 includes a paper supply roller 11, feeding rollers 12 through 15, paper guides 21 and 22, and a roller driving mechanism (not shown) for driving the rollers. Paper P is transported, page by page, from the paper cassette 4 to the fixing mechanism 30.

The fixing mechanism 30 includes a heat roller 31 which has a halogen lamp inside, and a press roller 83.

Figure 2:
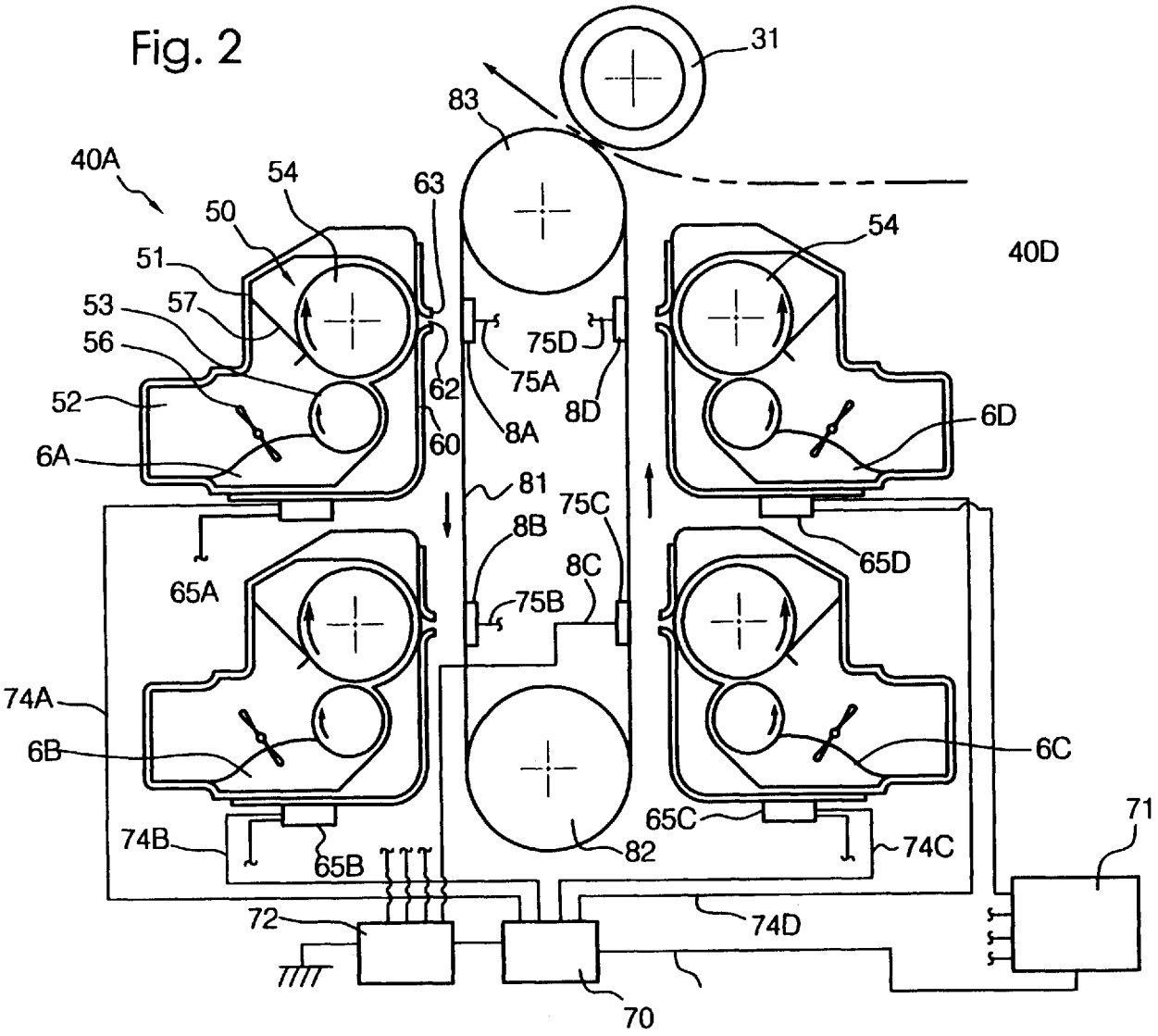
FIG. 2 illustrates the detailed structure of a major portion of the image forming apparatus shown in FIG. 1.

As shown in FIG. 2, the image recording unit 40A uses yellow toner 6*a* to record yellow pixels, the image recording unit 40B uses magenta toner 6*b* to record red pixels, the image recording unit 40C uses cyan toner 6*c* to record blue pixels, and the image recording unit 40D uses black toner 6*d* to record black pixels. Image recording units 40A and 40B are disposed on an opposite side of the transfer unit 80 from image recording units 40C and 40D in a symmetrical fashion.

The transfer unit 80 has an intermediate transfer belt 81, one surface of which faces the four image recording units 40A through 40D. Four back electrodes 8A through 8D are positioned on the other surface of the intermediate transfer belt 81 so that each of the back electrodes 8A through 8D opposes one of the image recording units 40A through 40D, with the intermediate transfer belt 81 therebetween.

The intermediate transfer belt 81 loops around the driving roller 82 and the press roller 83, and extends along the back electrodes 8A through 8D. The driving roller 82 is driven by a motor (not shown) and feeds the intermediate transfer belt 81 in the direction indicated by the solid arrows shown in FIGS. 1 and 2. The press roller 83 and the heat roller 31 form the fixing mechanism 30. The intermediate transfer belt 81 and the paper P are pressed together between the press roller 83 and the heat roller 31, while being heated by the heat roller 31, so that the toner image, which is temporality formed on the intermediate transfer belt 81, is transferred and fixed onto the paper P.

The looped intermediate transfer belt 81 is made of a resin film, such as polyimide or polyester. Alternatively, the intermediate transfer belt 81 can be made of a metallic material, such as nickel or stainless steel. The surface of the looped intermediate transfer belt 81 is coated with either a fluorine layer or a silicon layer to enhance the fixation of the toner.

The four image recording units 40A through 40D will be explained in more detail with reference to FIG. 2. Since the four units have the same structure, except for the toner 6*a* through 6*d* contained therein, explanation will only be provided with respect to image recording unit 40A.

The image recording unit 40A includes a toner supply mechanism 50, an aperture electrode 60 which serves as an electrode array, and an integrated driving circuit 65A connected to the aperture electrode 60.

The toner supply mechanism 50 includes a metallic toner case 51, a toner container 52 formed inside the toner case 51, toner supply roller 53, a toner feed roller 54, toner stirring blades 56, and a toner control blade 57.

The width of the toner case 51 is several centimeters wider than the maximum width of paper P, which extends in a direction perpendicular to FIG. 2. The toner supply roller 53, the toner feed roller 54, the toner stirring blades 56, and the toner control blade 57 are disposed within the toner case 51. The toner supply roller 53 has a width greater than the maximum width of the paper P.

The toner supply roller 53 is made of foamed silicon material, and is supported so as to be rotatable about its axis. The toner supply roller 53 contacts toner 6*a* in the toner container 52 and, at the same time, contacts the toner feed roller 54 on the other side. The toner supply roller 53 is rotated by a roller driving mechanism (not shown) in synchronization with the toner feed roller 54 in the direction indicated by the small arrows in FIG. 2. The toner 6*a* carried by the toner supply roller 53 is negatively charged due to the friction generated at the contact surface between the toner supply roller 53 and the toner feed roller 54. Consequently, the negatively charged toner 6*a* is supplied to the toner feed roller 54.

The toner feed roller 54 is a metallic roller. The outer surface of the toner feed roller 54 is coated with a semiconductor layer. The toner feed roller 54 is also supported so as to be rotatable about its axis, and is rotated by gears (not shown) in the direction indicated by the arrow so as to be synchronized with the toner supply roller 53.

The toner 6*a* supplied by the toner supply roller 53 adheres to the outer surface of the toner feed roller 54 and forms a toner layer. The toner control blade 57 is made of an insulating material and smoothes the toner layer until the thickness of the toner layer reaches a prescribed thickness (about 20–50 $\mu$m).

The toner stirring blades 56 receive power from the toner feed roller via several gears (not shown) including a reduction gear, and rotate slowly to stir the toner 6*a* while feeding toner 6*a* toward the toner supply roller 53.

Figure 3:
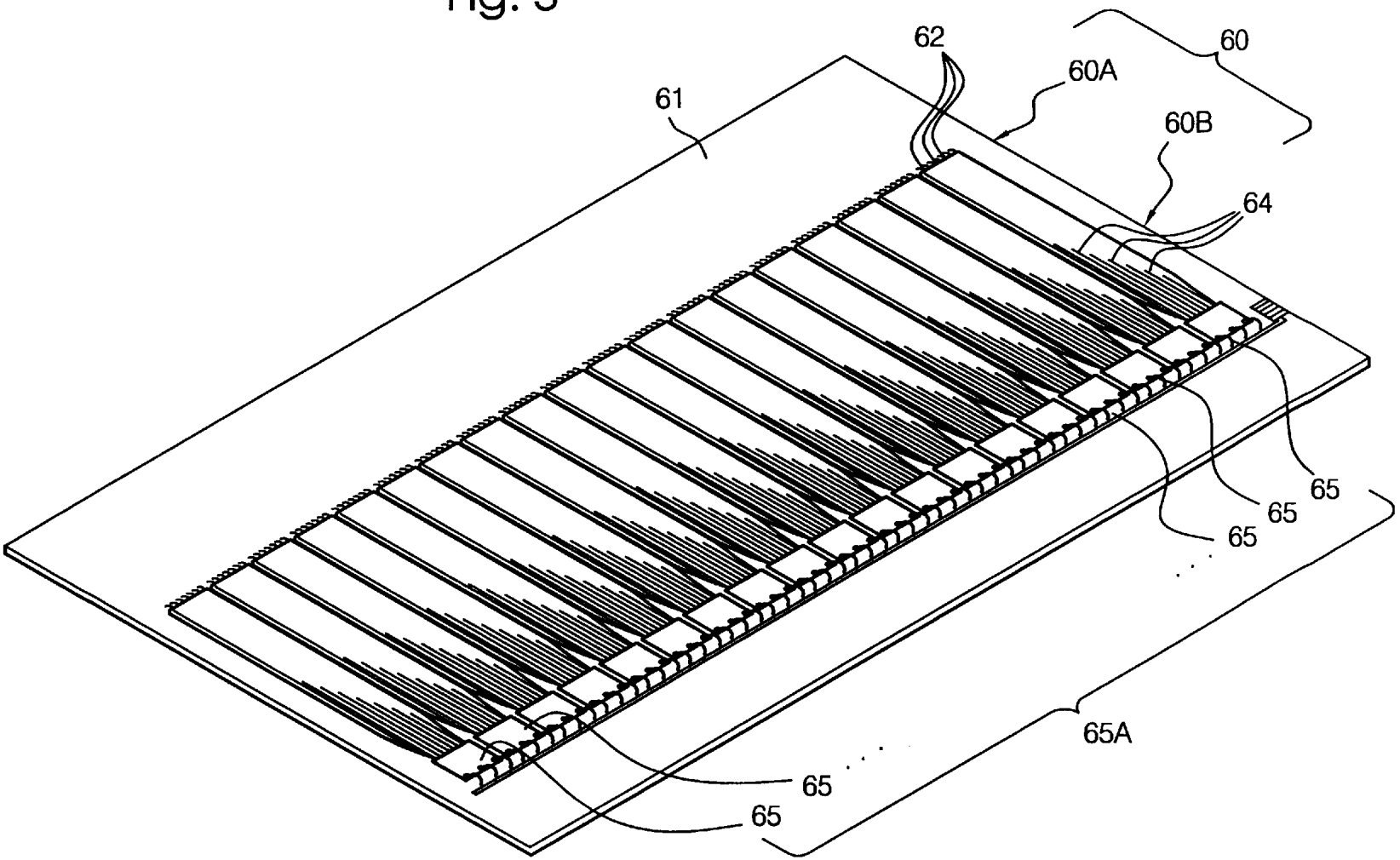
FIG. 3 is a perspective view of an aperture electrode used in the image forming apparatus shown in FIG. 1.
Figure 4:
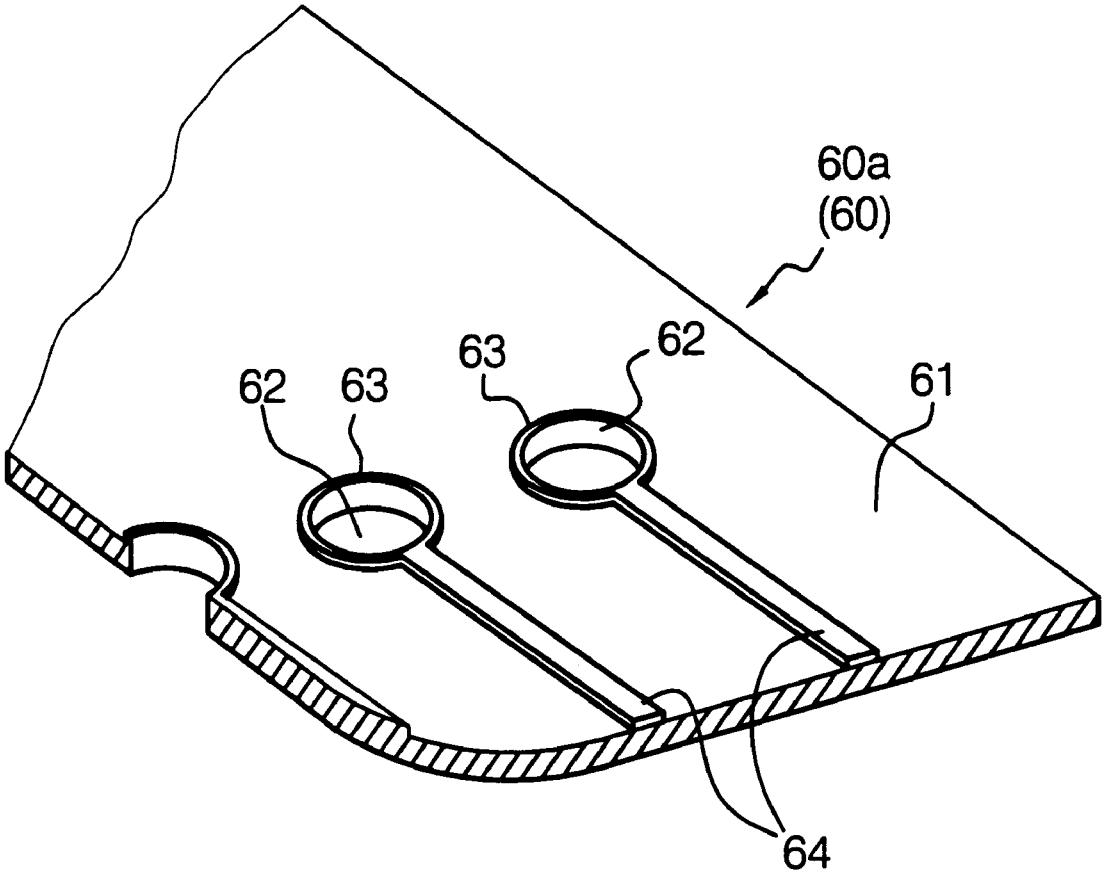
FIG. 4 is an enlarged partial perspective view of apertures and an area adjacent to the apertures of the aperture electrode shown in FIG. 3.

FIGS. 3 and 4 show the structure of the aperture electrode 60.

The aperture electrode 60 includes a flexible insulated sheet 61 made of a synthetic resin (e.g., polyimide), which has a thickness of, for example, 25 $\mu$m. A row of minute apertures 62, which serve as charge passages, are formed in the insulating sheet 61. A ring-shaped control electrode 63 is formed around each of the apertures 62 on the top surface of the insulated sheet 61. A lead 64 extends from each of the control electrodes 63. The control electrodes 63 and the leads 64 are covered with an insulating film (not shown), which is then covered with an anti-electrification film (not shown).

Each aperture 62 constitutes, for example, a cylindrical passage having a diameter of 65 $\mu$m. A plurality of the apertures 62 are arranged in a row in the horizontal direction, which is perpendicular to the paper feed direction. The interval between adjacent apertures 62 is set to 127 $\mu$m in this embodiment. If the aperture electrode is specifically designed for A4 size paper (having a width of 210 mm), the number of apertures 62 and the number of control electrodes 63 are set to approximately 1700.

The control electrodes 63 and the leads 64 are formed as thin films of copper by etching. The leads 64 are grouped into nineteen groups, and an electrode driving integrated circuit 65 is provided for each group. Thus a total of nineteen integrated circuits 65 are provided, each corresponding to approximately 90 control electrodes 63.

As shown in FIG. 2, the toner case 51 has an opening, through which a portion of the outer surface of the toner feed roller 54, onto which a layer of the toner 6*a* adheres, is exposed. The aperture electrode 60 is positioned so that its main body 60*a*, which includes the apertures 62 and the control electrodes 63, closes the opening of the toner case 51.

In this arrangement, the outer surface of the toner feed roller 54 contacts the apertures 62 of the aperture electrode 60, whereby the charged toner 6a is supplied to the apertures 62. As discussed above, the back side of the row of apertures 62 opposes the back electrode 8A, between which the intermediate transfer medium 80 travels along the looped path.

The control of the recording operation of the image recording units 40A through 40D is described below.

The image forming apparatus 1 includes a control unit 70 which receives image signals from external equipment (e.g., a computer). A control voltage generator 71 supplies power source voltages to the electrode driving integrated circuits 65A–65D which are provided in the image recording units 40A–40D. The electrode driving integrated circuits 65A–65D then apply control voltages to the associated control electrodes 63. On the other hand, a back voltage generator 72 supplies a predetermined level of back voltage to the back electrodes 8A–8D. The control unit 70 is connected to each of the electrode driving integrated circuits 65A–65D via control lines 74A–74D, respectively.

The control voltage generator 71 is also connected to the electrode driving integrated circuits 65A–65D via double-core control-voltage cables (not shown) so that control voltages (for example, 0V and 40V) can be applied to the control electrodes 63 in response to image signals. In particular, +40V voltage is applied to the control electrodes 63 that are used to form dot pixels, while 0V is applied to the control electrodes 63 that are not used to form the dot pixels.

In each of the image recording units 40A–40D, the toner feed roller 54 is grounded, and a common back voltage (e.g., +1000V) is supplied from the back voltage generator 72 to the four back electrodes 6A–6D, which correspond to the image recording units 40A–40D, via the back voltage lines 75A–75D. The control voltage generator 71 and the back voltage generator 72 are excited by a driving signal supplied from the control unit 70, and turned off by an OFF signal which is also supplied from the control unit 70.

A significant feature of the invention is that the image recording units 40A through 40D are separately driven according to the received image signal under the control of the control unit 70.

Figure 6:
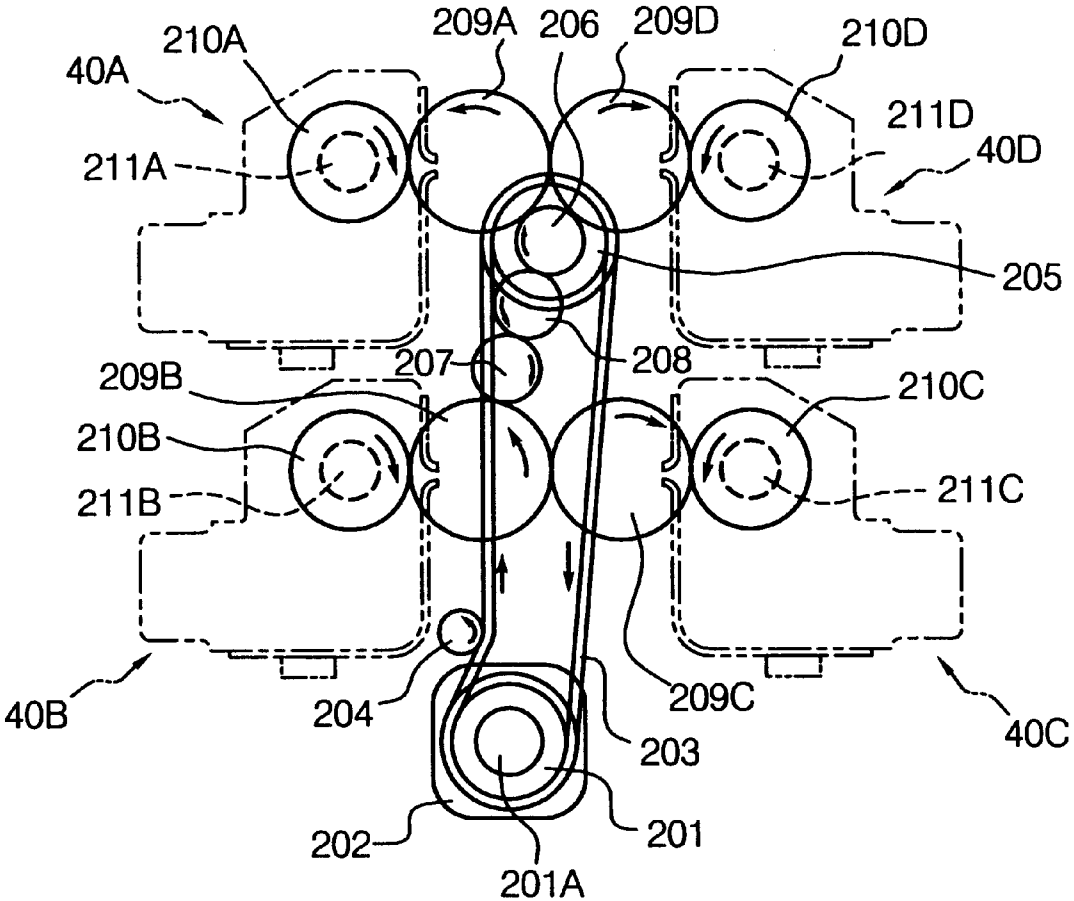
FIG. 6 schematically illustrates the structure of a power driving system of the image forming apparatus shown in FIG. 1.

FIG. 6 shows a power driving system of the image forming apparatus 1 according to the preferred embodiment of the invention.

A motor 201 is positioned at the bottom of the image forming apparatus 1. A driving pulley 202 is coupled with the rotation axis 201A of the motor 201. On the other hand, an input pulley 205 is positioned in the upper portion of the image forming apparatus 1.

A looped driving belt 203 is positioned around the input pulley 205 and the driving pulley 202 in order to transmit the driving force from the driving pulley 202 to the input pulley 205. A tension roller 204 is positioned in the vicinity of the motor 201 in order to provide an appropriate tension to the driving belt 203.

An input shaft driving gear 206 is directly connected to the input pulley 205, whereby power is transmitted from the input shaft driving gear 206 to the image recording units 40A–40D via the several gears.

In particular, driving power is transmitted from the input shaft driving gear 206 to the image recording unit 40A via an intermediate gear 209A and a final gear 210A, while driving power is transmitted from the input shaft driving gear 206 to the image recording unit 40B via intermediate gears 207, 208, another intermediate gear 209B, and final gear 210B.

The intermediate gear 209B further causes an intermediate gear 209C, which is positioned on the right side of intermediate gear 209B, to rotate, whereby a power is transmitted to a final gear 210C of the image recording unit 40C.

One side of an intermediate gear 209D is engaged with a final gear 210D of the image recording unit 40D, and the other side is engaged with the input shaft driving gear 206. However, the intermediate gear 209D is not engaged with the intermediate gear 209A of the image recording unit 40A because gears 209D and 209A are positioned in different planes.

The final gears 210A–210D are connected to the axes of the toner feed rollers 54 of the image recording units 40A–40D via electromagnetic clutches 211A–21D, respectively. The electromagnetic clutches 211A–211D are adapted to close and open the transmission paths from the final gears 210A–210D to the axes of the toner feed rollers 54 in response to control signals supplied from the control unit 70.

For example, if a single-color image is to be formed, three image recording units out of the four are not required. In this situation, power transmission to the three image recording units which are not required is cut off by the associated electromagnetic clutches 211 under the control of the control unit 70. Thus, only the image recording unit that is actually used to form the image is driven and is separated from the other image recording units. Moreover, if black text is to be formed in an upper half of a sheet and then a full-color photographic image is to be formed in a lower half of the sheet, the image recording unit 40A containing black toner 6*a* is the only image recording unit that is driven for the upper half of the printing operation, and all of the image recording units 40A through 40D are driven for the lower half of the printing operation.

Because the toner feed rollers 54 and the toner supply rollers 53 that are not required for a current printing job are kept at rest, the durability of the apparatus and the resultant image quality are kept high. Thus, the separate driving mechanism prevents the durability from degrading due to toner accumulating or adhering onto the rollers and the blades, and greatly reduces stains or unclearness in the resultant images due to the scattering of unnecessary toner which passes through the apertures 62 by mistake.

In operation, the control unit 70 determines whether the received image signal represents a black-and-white image or a full-color image. If the signal represents a full-color image, then all of the electromagnetic clutches 211A–211d are connected to the associated final gears 210A–210D in order to transmit the driving force generated by the motor 201 to the axis of the toner feed rollers 54 of the respective image recording units 40A–40D. Thus, all of the image recording units 210A–210D contribute to the printing operation of the full-color image.

If it is determined that the received signal represents a black-and-white image, then only the clutch 211D, which corresponds to the image recording unit 210D that has black toner 6*d*, is connected, while the rest of the electromagnetic clutches 211A–211C are kept open. Accordingly, the driving force generated by the motor 201 is only transmitted to the image recording unit 40D, and the rest of the image recording units 40A–40C are not activated. This can prevent, during the printing operation of the black-and-white image, color toner from scattering or adhering onto the resultant images. This can also prevent the durability of the apparatus or other parts from deteriorating.

Wrap spring clutches may be used in place of the electromagnetic clutches 211A–211D.

The image recording operation carried out by the image recording units 40A–40D is explained below in more detail using image recording unit 40A as an example.

Figure 5:
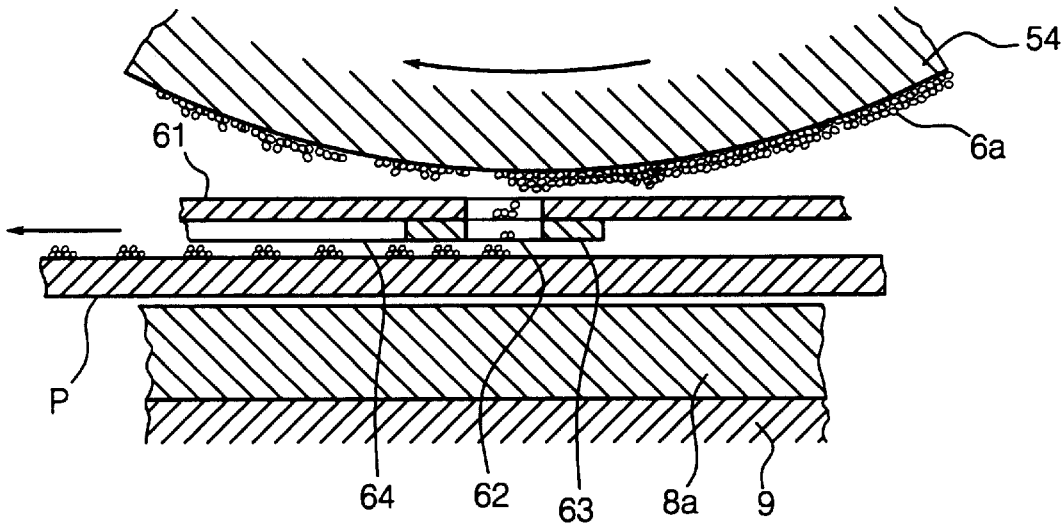
FIG. 5 is a enlarged vertical cross-sectional view of an image recording unit taken along a plane perpendicular to the axial direction of a toner feed roller.

As shown in FIG. 5, a layer of negatively charged toner 6*a* adhere onto the outer surface of the toner feed roller 54. As the feed roller 54 rotates, the toner layer passes directly above the row of apertures 62 of the aperture electrode 60. If +40V voltage is applied to the control electrode 63, an electric field is produced which is directed from the control electrode 63 toward the toner feed roller 54. As a result, the toner 6*a* is attracted to the control electrode 63 by the electrostatic force of the electric field. Specifically, toner 6*a* flies toward the back electrode 8A due to the electrostatic force caused by the strong electric field which is directed from the back electrode 8A toward the control electrode 63. The flying toner 6*a* adheres onto the intermediate transfer medium 81 and forms dot pixels on paper P. In contrast, if 0V is applied to the control electrode 63, no electric field is produced, and if a negative voltage is applied, an electric field is produced in the opposite direction. In either case, no dots or pixels are formed on the paper P.

When a color image is formed in the image forming apparatus 1, the control unit 70 controls the electrode driving integrated circuits 65A–65D individually based on four different image signals, each representing one of multiple colors including yellow, magenta, cyan and black.

In this context, a printing position is defined as a position which is located on the intermediate transfer medium 81 and facing the row of apertures 62 of the aperture electrode 60. The image recording units 40A–40D are positioned along the moving direction of the intermediate transfer medium 81 so that the printing positions of the four image recording units 40A–40D are located on the intermediate transfer medium 81 at predetermined intervals.

It may take time $\tau$ to move the intermediate transfer medium 81 a length equal to the predetermined interval. In this embodiment, the control unit 70 first generates a control signal based on the yellow image signal, then subsequently generates control signals based on the magenta image signal, the cyan image signal, and the black image signal every $\tau$ seconds. In other words, the control signals for the respective colors are generated with time delays of $\tau$, $2\tau$, and $3\tau$ after the first control signal is generated. Thus, a desired full-color image is formed on the intermediate transfer medium 81 as the intermediate transfer medium 81 moves along its looped path. The full-color toner image formed on the intermediate transfer medium 81 is then transferred onto paper P by the transfer unit 80 and the fixing mechanism 30.

As described above, the image forming apparatus according to the invention can prevent different color toner particles from adhering onto an output image during single-color or double-color printing operations. It can also prevent the durability of the apparatus from deteriorating.

Figure 7:
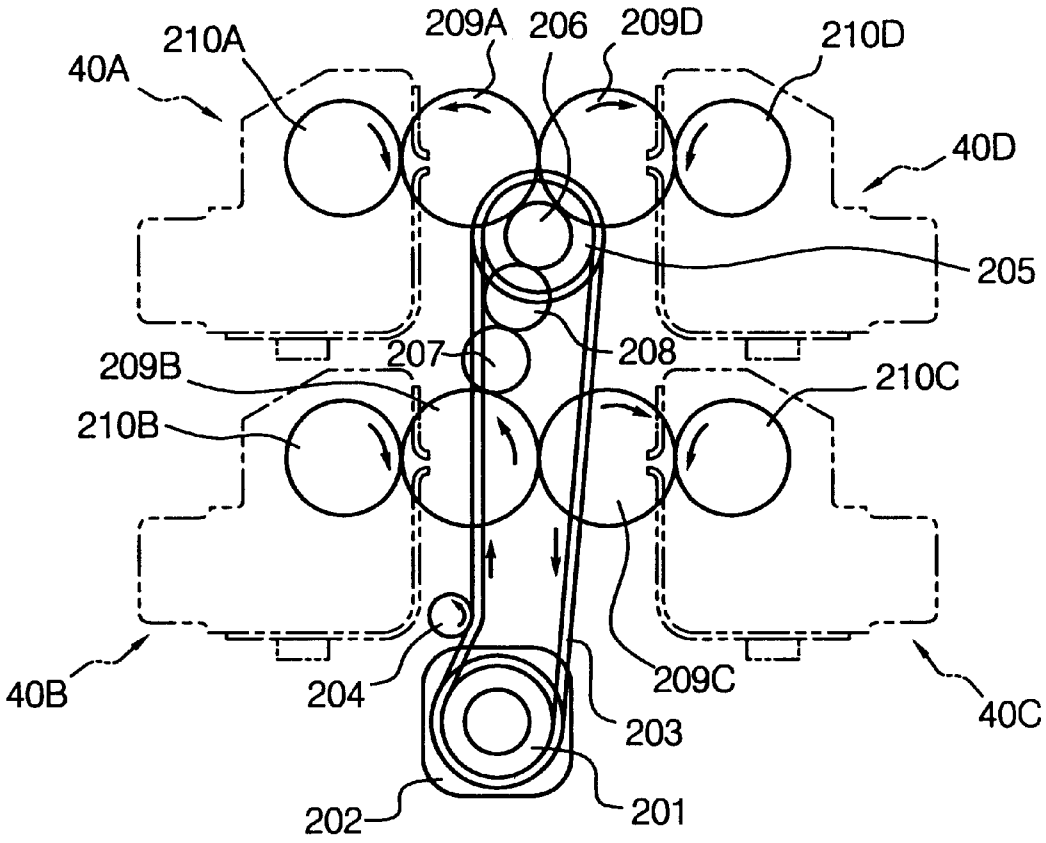
FIG. 7 is a right side view of a modification of the power driving system shown in FIG. 6.
Figure 8:
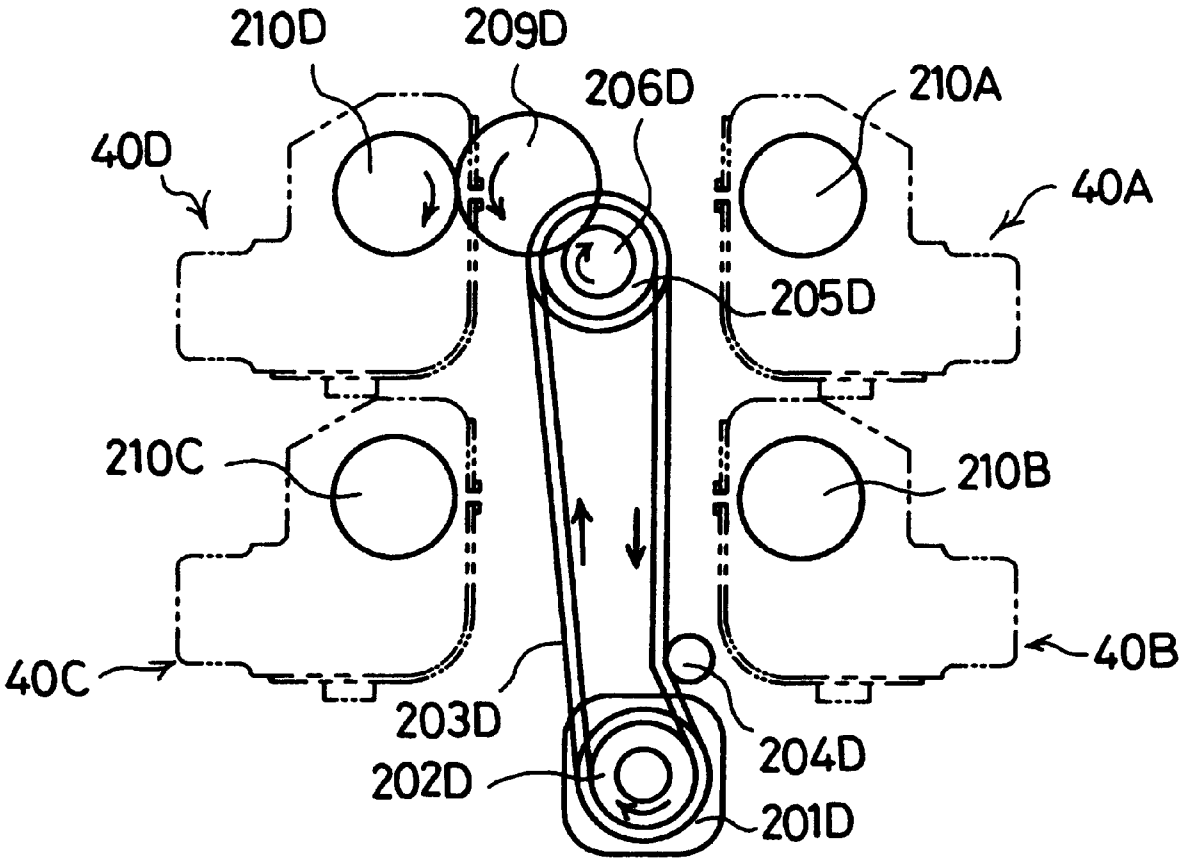
FIG. 8 is a left side view of the modification of the power driving system shown in FIG. 7.

FIGS. 7 and 8 show a modification of the image forming apparatus shown in FIG. 1. The same elements as those shown in FIGS. 1–6 are denoted by the same numerical symbols.

In an ordinary office environment, black-and-white print (or text print) constitutes the majority of printing operations. In view of this situation, in the modification shown in FIGS. 7 and 8, the power driving system of the image recording unit 40D, which corresponds to black images, is completely separated from the rest of the image recording units 40A–40C. FIG. 7 is a right side view of the power driving system of the image forming apparatus, while FIG. 8 is a left side view of the same apparatus.

Two motors 201 and 201D are positioned at the bottom of the image forming apparatus 1 on either side of the apparatus. The power driving system is grouped into two lines, namely, a right driving line for image recording units 40A–40C for yellow, magenta, and cyan, and a left driving line for image recording unit 40D for black.

The right driving line for the three colors (FIG. 7) has the same structure as the power driving system shown in FIG. 6, except that the black image recording unit 40D is not activated. On the other hand, in the left driving line for black images shown in FIG. 8, the motor 201D causes a driving belt 203D to rotate via a driving pulley 202D. An appropriate tension is applied to the driving belt 203D by the tension roller 204D. The driving belt 203D travels along a looped path around the input pulley 205D and the driving pulley 202D. The input pulley 205D is connected directly to an input shaft driving gear 206D, which is then connected to a final gear 210D via an intermediate gear 209D.

Thus, excitation of the two motors 201 and 201D is controlled by the control unit 70 which generates drive signals (i.e., control signals) based on the image signals and supplies the drive signals to the necessary motor(s). For example, when a black-and-white image is to, be printed, no drive signal is supplied to motor 201.

In this example, color image recording units which are not required remain at rest, so that color toner is prevented from scattering or adhering onto the resultant black-and-white image, while the durability of the apparatus remains high. In addition, since two motors are used in the image forming apparatus, fluctuations in the action of the motor due to load variations can be reduced and, accordingly, the image recording units are driven by a stable driving power. This arrangement can eliminate faint stripes that appear on the output image due to the load fluctuation of the motor.

While the invention has been described by way of exemplary embodiments, it is understood that many changes and substitutions can be made without departing from the scope of the invention.

For example, although the image forming apparatus has four image recording units corresponding to four colors in the embodiment, this invention can be applied to any image forming apparatus having two or more image recording units. These modifications will be apparent to those skilled in the art.

What is claimed is:

1. An image forming apparatus, comprising:

a plurality of image recording units that form an image, each image recording unit of the plurality of image recording units comprising:

at least one toner passage respectively provided with a control electrode that controls charged toner to pass through the respective toner passage;

a control circuit that controls each control electrode by applying a voltage to the control electrode of an electrode array; and a toner supply mechanism which supplies charged toner to the toner passages;

a driving system which drives each toner supply mechanism of said plurality of image recording units;

a driving separation mechanism that separates at least one toner supply mechanism from said plurality of toner supply mechanisms, such that only the at least one toner supply mechanism is not driven by the driving system to prevent the charged toner from supplying the toner passages; and a control system that controls the driving separation mechanism.

2. The apparatus of claim 1, further comprising a clutch in the driving separation mechanism.

3. The apparatus of claim 2, wherein the clutch includes an electromagnetic clutch.

4. The image forming apparatus as claimed in claim 3, wherein the driving system has a motor that drives said plurality of toner supply mechanism, and each image recording unit of the plurality of image recording units has an electromagnetic clutch.

5. The image forming apparatus as claimed in claim 4, wherein the toner supply mechanism comprises:

a toner container which contains toner;

a toner feed roller which feeds the toner to the toner passages;

toner stirring blades which stir the toner contained in the toner container; and a toner supply roller which supplies stirred toner to the toner feed roller.

6. The image forming apparatus as claimed in claim 5, further comprising:

a driving pulley fixed to a rotation shaft of the motor;

a driving belt;

an input pulley to which the rotation of the driving pulley is transmitted through the driving belt;

an input shaft driving gear fixed to the input pulley;

an intermediate gear engaged with the input shaft driving gear; and a final gear engaged with the intermediate gear, the final gear being connected with an axis of the toner feed roller via the electromagnetic clutch.

7. The image forming apparatus as claimed in claim 6, further comprising:

an intermediate transfer medium having first and second opposite surfaces which receives a toner image at the first surface and transfers the toner image onto the recording medium; and a back electrode disposed at the second surface of the intermediate transfer medium so that the intermediate transfer medium is disposed between the back electrode and the toner passages of the image recording units.

8. The image forming apparatus as claimed in claim 2, wherein the driving system has a plurality of motors that drive said plurality of toner supply mechanisms, and when a single-color image is to be formed, the control unit controls the motors so that only one motor which is associated with a selected color of the plurality of motors is driven.

9. The image forming apparatus as claimed in claim 8, wherein the plurality of image recording units include four image recording units, each image recording unit of the four image recording units corresponding to one of yellow, magenta, cyan and black, and wherein when a black-and-white image is to be formed, the control unit only allows the motor for the black image recording unit to be driven, and when a full-color image is to be formed, the control unit allows all of the motors for the four image recording units to be driven at one time.

10. The apparatus of claim 2, further comprising an intermediate transfer medium wherein the image forming unit transfers toner to the intermediate transfer mechanism without contacting the intermediate transfer mechanism.

11. The image forming apparatus as claimed in claim 1, wherein the plurality of image recording units include four image recording units, each image recording unit of the four image recording units corresponding to one of yellow, magenta, cyan and black, and wherein when a black-and-white image is to be formed, the driving separation mechanism only selects the black image recording unit to be driven, and when a full-color image is to be formed, the driving separation mechanism selects all of the image recording units to be driven at one time.

12. An image forming apparatus, comprising:

means for forming an image, the means for forming including a plurality of image recording units, each image recording unit of the plurality of image recording units having:

at least one toner passage each at least one toner passage respectively having a control electrode that controls the amount of charged toner that passes through the toner passage, each toner passage being provided with a first control means;

the first control means is driven by a second control means which is individually controlled by a voltage applied to each electrode of an electrode array; and a toner supply means for supplying charged toner to the toner passage;

means for driving each toner supply means of said plurality of image recording units;

means for separating at least one toner supply means from said plurality of toner supply means, such that only the at least one toner supply means is not driven by the means for driving to prevent the charged toner from supplying the toner passages; and a third means for controlling the driving separation means.

13. The apparatus of claim 12, further comprising a clutch means within the means for separating.

14. The image forming apparatus as claimed in claim 13, wherein the means for separating has electromagnetic clutches which separates the at least one image recording unit from the plurality of image recording units under control of the means for controlling so that only the at least one separated image recording unit is driven by the means for driving.

15. The image forming apparatus as claimed in claim 14, wherein the means for driving has a motor that drives said plurality of toner supply means, and each image recording unit of the plurality of image recording units has an electromagnetic clutch.

16. The image forming apparatus as claimed in claim 15, wherein the means for supplying comprises:

a toner container which contains toner;

a toner feed roller which feeds the toner to the toner passages;

toner stirring blades which stir the toner contained in the toner container; and a toner supply roller which supplies stirred toner to the toner feed roller.

17. The image forming apparatus as claimed in claim 16, further comprising:

a driving pulley fixed to a rotation shaft of the motor;

a driving belt;

an input pulley to which the rotation of the driving pulley is transmitted through the driving belt;

an input shaft driving gear fixed to the input pulley;

an intermediate gear engaged with the input shaft driving gear; and a final gear engaged with the intermediate gear, the final gear being connected with an axis of the toner feed roller via the electromagnetic clutch.

18. The image forming apparatus as claimed in claim 17, further comprising:

an intermediate transfer medium having first and second opposite surfaces which receives a toner image at the first surface and transfers the toner image onto the recording medium; and a back electrode disposed at the second surface of the intermediate transfer medium so that the intermediate transfer medium is disposed between the back electrode and the toner passages of the image recording units.

19. The apparatus of claim 13, further comprising an intermediate transfer means that transfers toner from the means for forming an image to a means for recording an image wherein the intermediate transfer means does not contact the means for forming an image.

20. The image forming apparatus as claimed in claim 13, wherein the means for driving has a plurality of motors that drive said plurality of toner supply means, and when a single-color image is to be formed, the means for controlling controls the motors so that only one motor which is associated with a selected color of the plurality of motors is driven.

21. The image forming apparatus as claimed in claim 21, wherein the plurality of image recording units include four image recording units, each image recording unit of the four image recording units corresponding to one of yellow, magenta, cyan and black, and wherein when a black-and-white image is to be formed, the means for controlling only allows the motor for the black image recording unit to be driven, and when a full-color image is to be formed, the means for controlling allows all of the motors for the four image recording units to be driven at one time.

* * * * *